US006865969B2

(12) United States Patent
Stevens

(10) Patent No.: US 6,865,969 B2
(45) Date of Patent: Mar. 15, 2005

(54) ADJUSTABLE PEDAL FOR EXERCISE DEVICES

(76) Inventor: Kerry Peters Stevens, 372 Hills Borough Road, Auckland (NZ)

( * ) Notice: Subject to any disclaimer, the term of this patent is extended or adjusted under 35 U.S.C. 154(b) by 0 days.

(21) Appl. No.: 10/402,762

(22) Filed: Mar. 28, 2003

(65) Prior Publication Data

US 2004/0187628 A1 Sep. 30, 2004

(51) Int. Cl.[7] ..... G05G 5/06; F16C 11/00; F16C 1/14

(52) U.S. Cl. ..... 74/594.7; 74/527; 74/594.4; 74/594.1; 482/57; 482/62

(58) Field of Search ..... 74/594.1, 594.2, 74/594.4, 594.7, 527, 512; 482/57, 62

(56) References Cited

U.S. PATENT DOCUMENTS 363,522 A * 5/1887 Knous ..... 74/594.1
4,648,287 A * 3/1987 Preskitt ..... 74/594.1
4,867,441 A * 9/1989 Blakeman ..... 482/57
4,902,002 A * 2/1990 Huang ..... 482/62
5,161,430 A * 11/1992 Febey ..... 74/594.7
5,640,886 A * 6/1997 Lai ..... 74/527

FOREIGN PATENT DOCUMENTS

EP 0 327 449 * 8/1989 ..... 74/512

* cited by examiner

*Primary Examiner*—Vinh T. Luong
(74) *Attorney, Agent, or Firm*—Charles E. Baxley

(57) ABSTRACT

A pedal structure for exercise devices includes a pedal having a groove for receiving an operation rod therein and two positioning ports are defined in a side of the pedal. The positioning ports are continuous notches which are in communication with each other. Two connection ports are located on the operation rod and communicate with the positioning ports. Two positioning members respectively extend through the positioning ports and are engaged with the connection ports. The positioning members are able to slide between the continuous notches so as to adjust the effective length of the pedal relative to the operation rod.

1 Claim, 7 Drawing Sheets

ADJUSTABLE PEDAL FOR EXERCISE DEVICES

FIELD OF THE INVENTION

The present invention relates to a pedal which is adjustable on an operation rod so as to adjust the effective length of the pedal.

BACKGROUND OF THE INVENTION

A conventional exercise device such as elliptical exerciser or stair climbing exerciser include two pedals which are respectively connected to two respective operation rods. A distal end of each of the operation rods is connected to an arm which can be pivoted reciprocally when the feet of a user step on the two pedals. The trace of the two pedals is an oval path such that the muscles of the feet can be exercised during the operation. The pedals are made large enough so as to fit different users needs and the larger the pedal is, the higher manufacturing cost is required. The mold for making the pedals has to be bulky and the travel of the plastic injection machine is also long, both of the two factors affect the cost of the manufacture. The number of the pedals that one process of plastic injection can produce is limited because of the size of the pedals and the cooling period is increased between two adjacent injections.

The present invention intends to provide a pedal structure wherein the pedal can be adjusted along the operation rod according different needs.

SUMMARY OF THE INVENTION

In accordance with one aspect of the present invention, there is provided a pedal structure for exercise devices and the pedal structure comprises a pedal having a groove defined therein an underside thereof so as to receive an operation rod therein, and two positioning ports are defined in a side of the pedal. The operation rod has two connection ports and each of which communicates with the positioning ports. Two positioning members respectively extend through the positioning ports and are engaged with the connection ports on the operation rod. The positioning members is movably engaged with the positioning ports.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
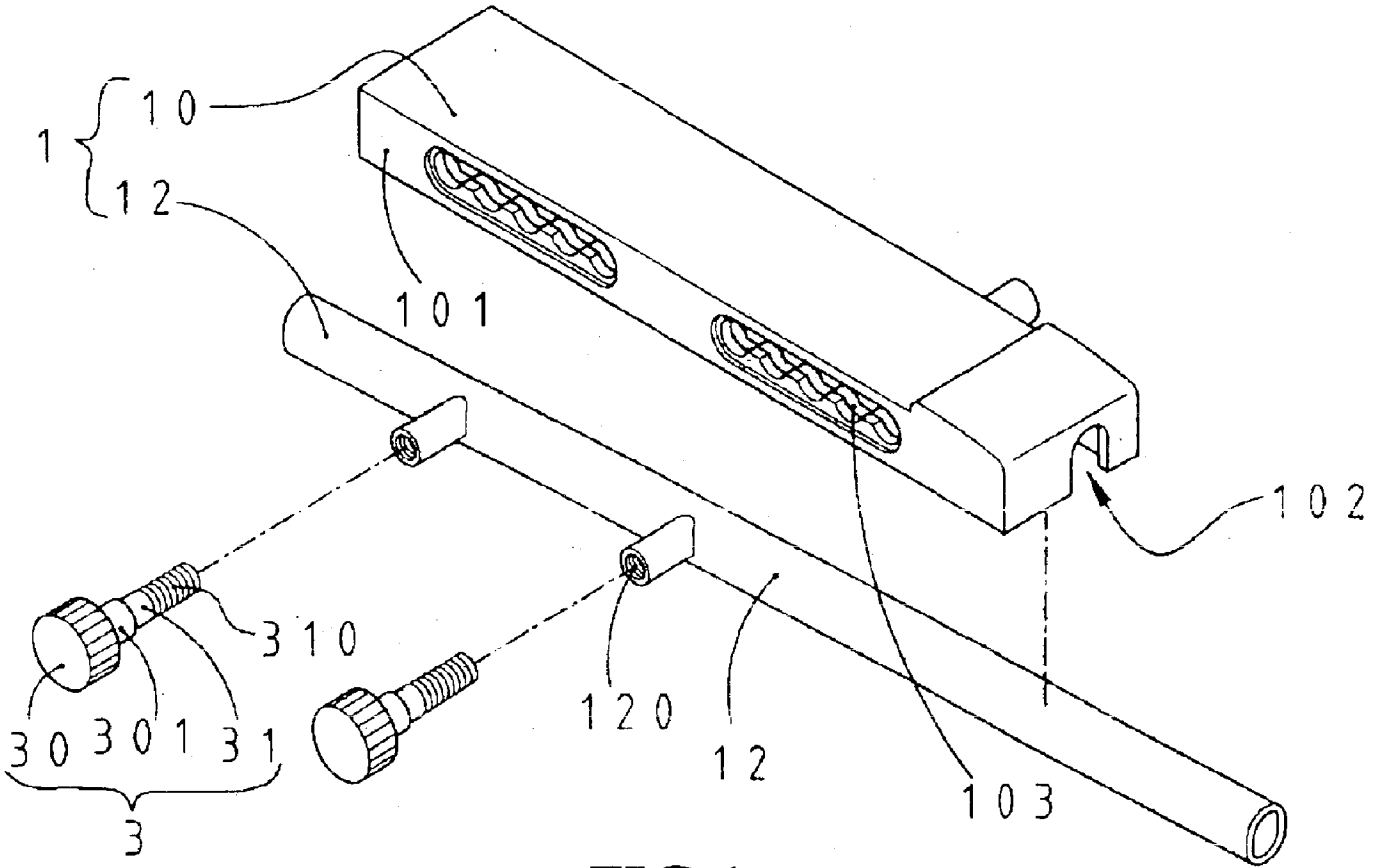
FIG. 1 is an exploded view to show the pedal structure of the present invention.
Figure 2:
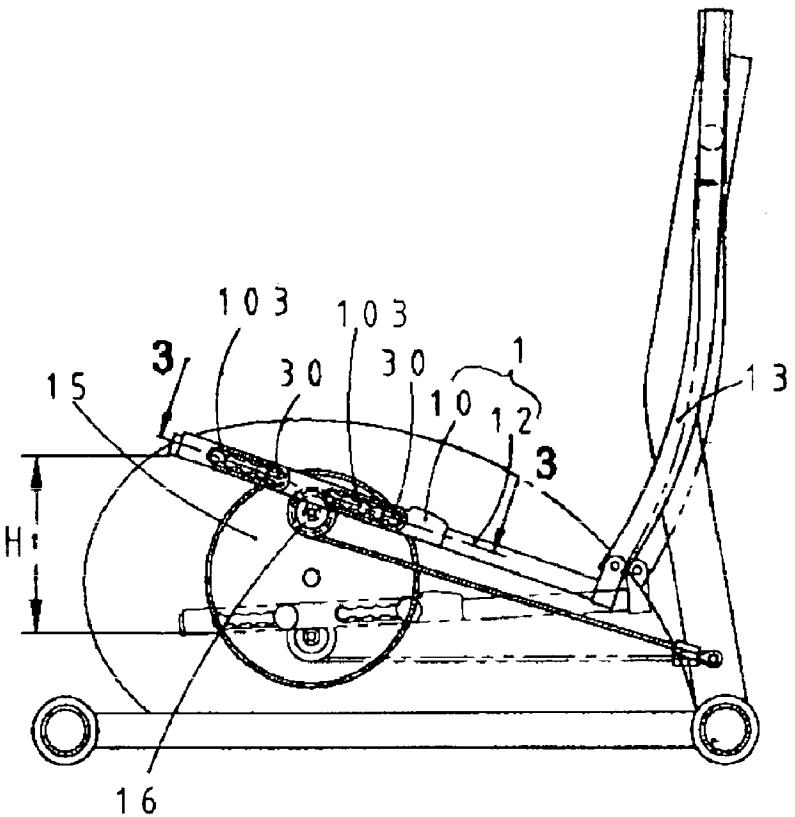
FIG. 2 is a side view to show the pedal structure is used for an elliptical exerciser.
Figure 3:
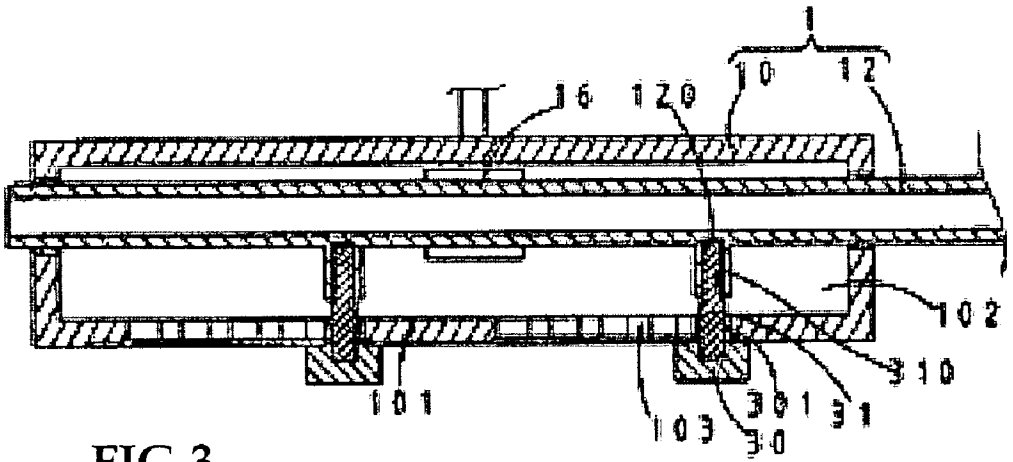
FIG. 3 shows a cross sectional view, taken upon plane 3—3 in FIG. 2, of the pedal structure of the present invention.
Figure 7:
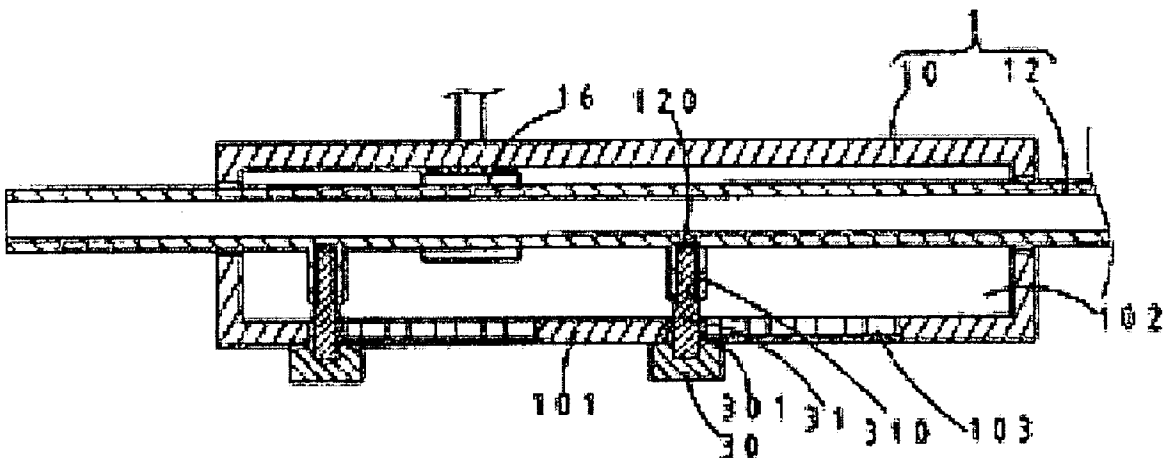
FIG. 7 is a cross sectional view, taken upon plane 7—7 in FIG. 6 and shows the positioning members are screwed with the connection ports again after the pedal is adjusted.
Figure 4:
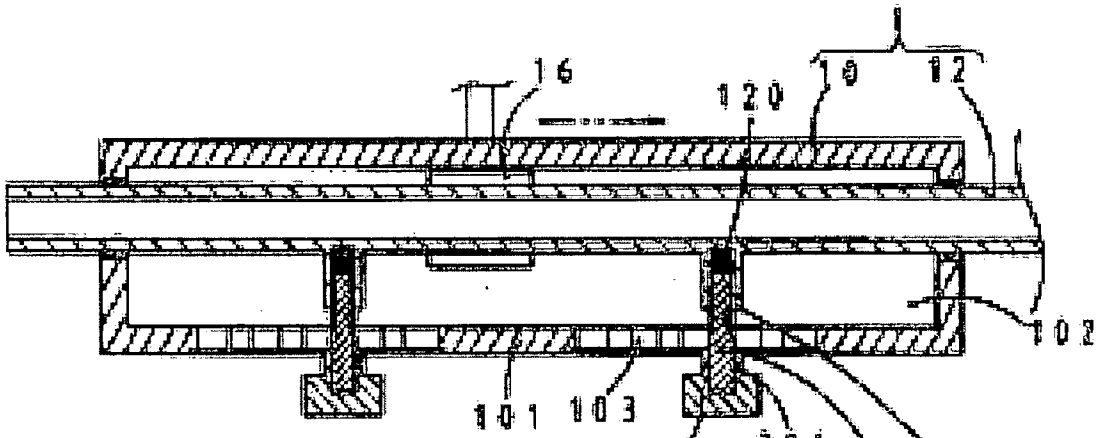
FIG. 4 is a cross sectional view, taken upon plane 3—3 in FIG. 2 and shows the positioning members are unscrewed to let the plain section engaged with the periphery of the notches.
Figure 5:
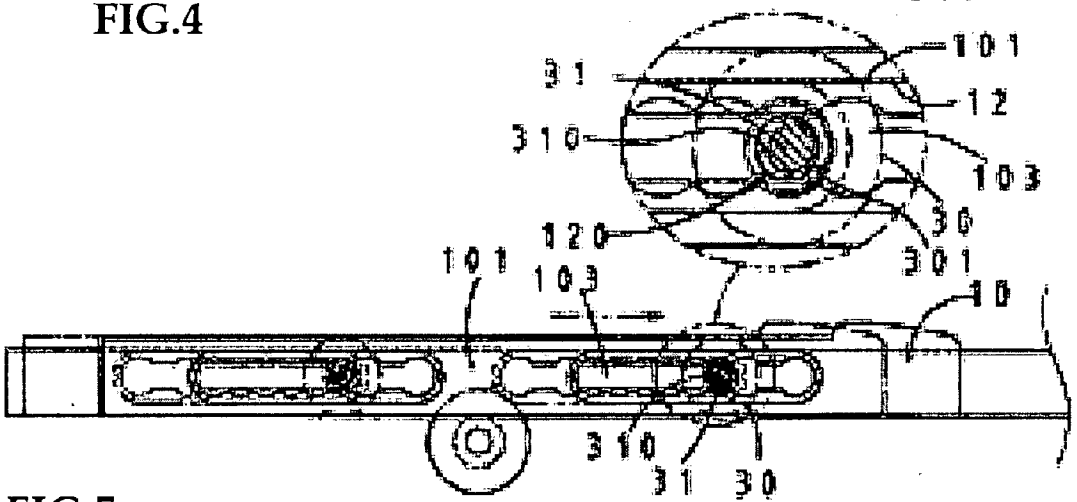
FIG. 5 shows the pedal is shifted along the operation rod.

Referring to FIGS. 1 to 3, the pedal structure 1 for exercise devices of the present invention comprises a pedal 10 having a groove 102 defined an underside thereof so that an operation rod 12 is engaged therewith. Two positioning ports 103 are defined in a side 101 of the pedal 10 and each of the positioning ports 103 includes continuous notches which are in communication with each other. The groove 102 communicates with the positioning ports 103. Two connection ports 120 are located on the operation rod 12 and each of which is a tube with threaded inner periphery.

Two positioning members 3 respectively extend through the positioning ports 103 and are threadedly engaged with the connection ports 120 on the operation rod 12. Each of the positioning members 3 has a head portion 30, a plain section 301 and a threaded section 310 which is threadedly connected to the connection port 120 corresponding thereto. The plain section 301 is slidably shifted between the continuous notches of the positioning ports 103.

Figure 6:
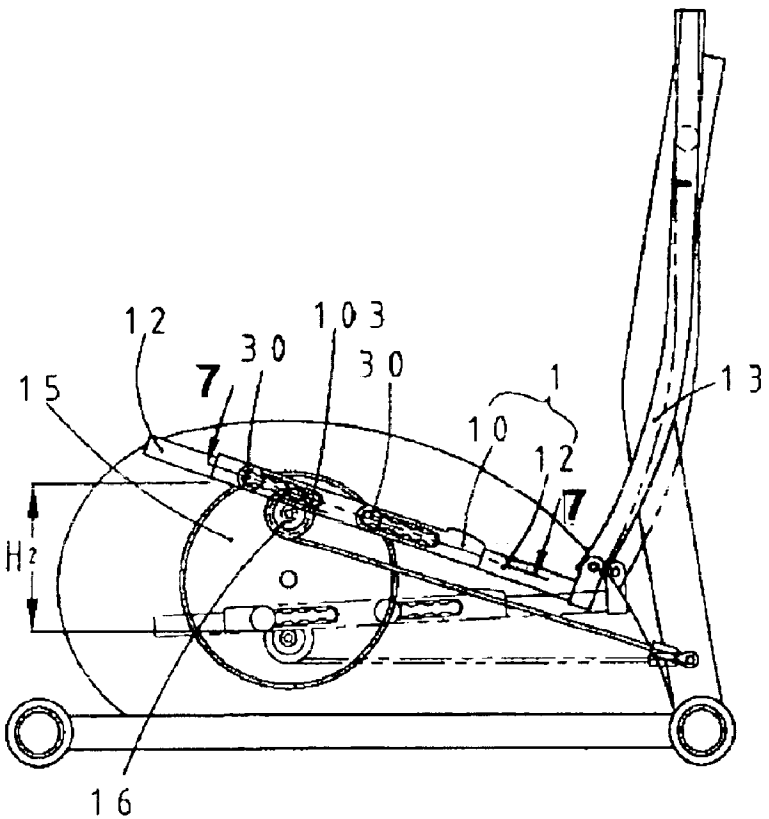
FIG. 6 shows the pedal is shifted in the elliptical exerciser.

Referring to FIGS. 4 to 7, when adjusting the pedal 10, the positioning members 3 are first unscrewed to allow the plain sections 301 to engage with the periphery of the notches in the positioning ports 103. The pedal 10 is then movably along the operation rod 12 to a desired position, and the positioning members 3 are then re-screwed to the connection ports 120 again. By this way, the effective length of the pedal 10 can be adjusted relative to the operation rod 12 so that the distance "H1" as shown in FIGS. 2 and 6 can be adjusted.

Figure 8:
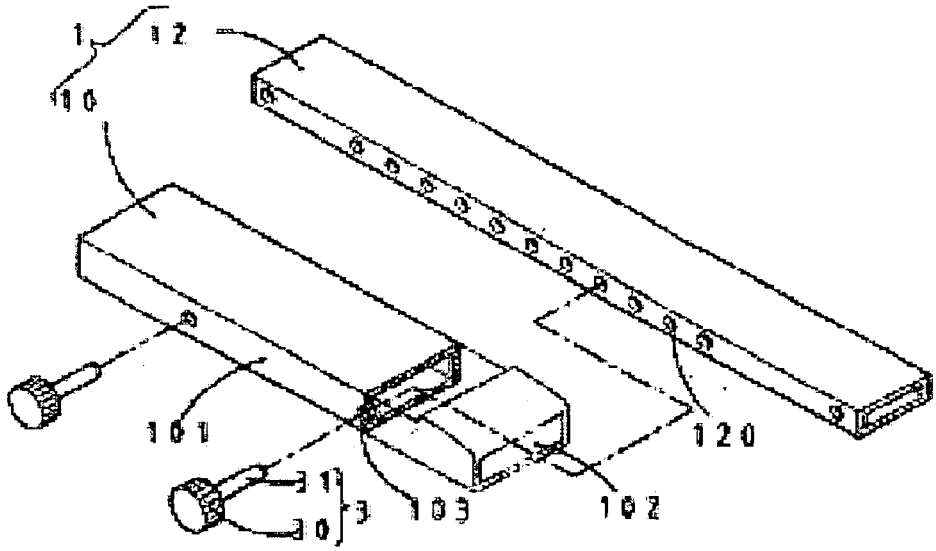
FIG. 8 is an exploded view to show another embodiment of the peal structure of the present invention.

FIG. 8 shows another embodiment of the present invention wherein the operation rod 12 is slidably inserted in the peal 10 and the two positioning ports 103 are two holes and the two connection ports 120 are a plurality of holes. The positioning members 3 each have a head portion 30 and a shank 31 which is inserted in one of the holes in the connection ports 120 via the positioning ports 103.

Figure 9:
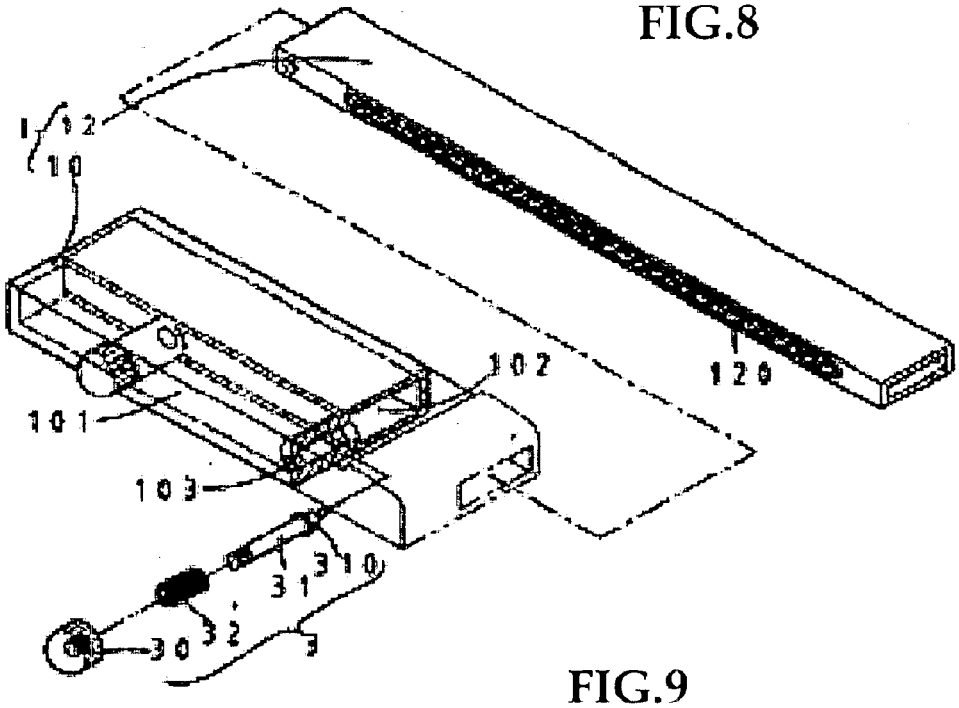
FIG. 9 is an exploded view to show yet another embodiment of the peal structure of the present invention.

FIG. 9 shows that two positioning ports 103 are two holes and the two connection ports 120 includes continuous notches which are in communication with each other. The positioning members 3 each have a head portion 30, a shank 31 and a spring 32 which is mounted to the shank 31 and biased between the head portion 30 and a stop 310 on the shank 31. The shank 31 is threadedly connected to the head portion 30 and is inserted in one of the continuous notches by pulling the head portion 30 outward and shifting the pedal 10 and then releasing the head portion 30 to insert the shank 31 in one of the holes of the connection ports 120.

Figure 10:
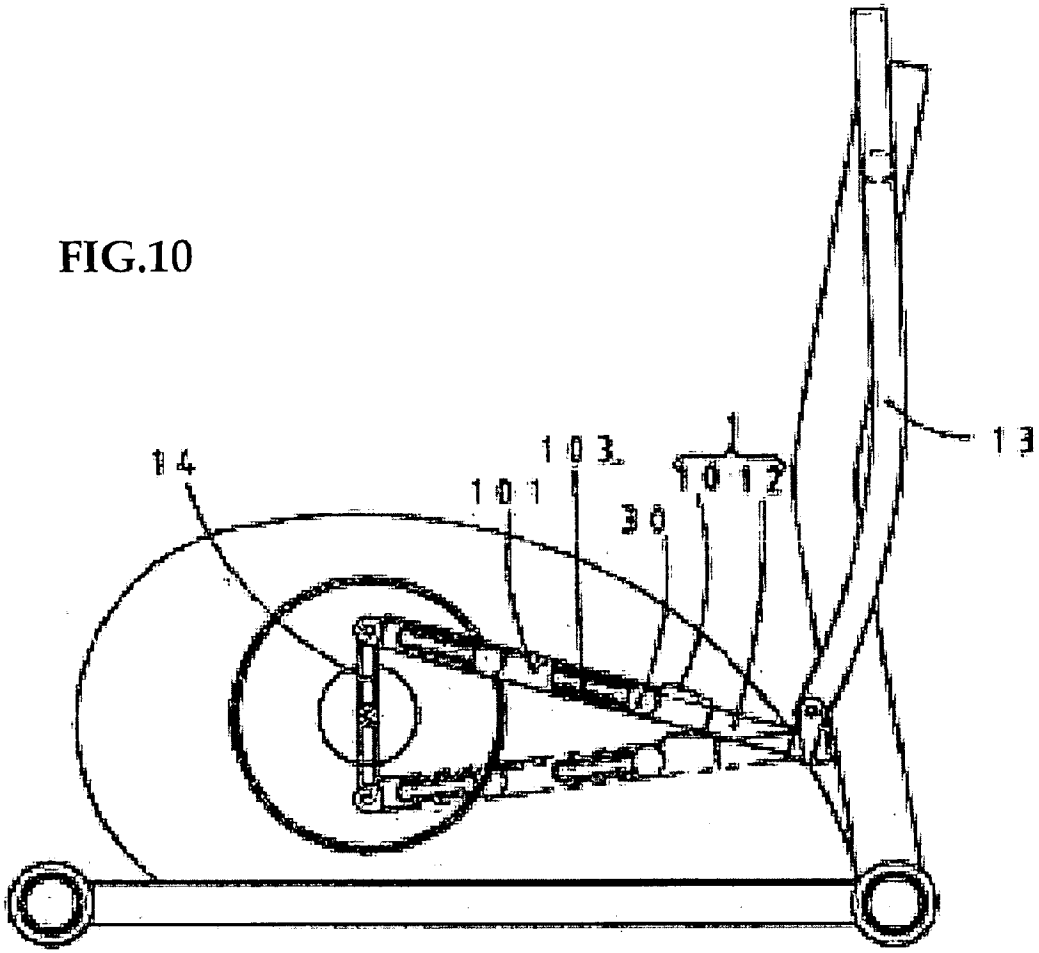
FIG. 10 shows another arrangement of the pedal structure of the present invention in an elliptical exerciser.

FIG. 10 shows another arrangement of the pedal structure of the present invention in an elliptical exerciser, wherein a bar 14 connected to a shaft of a wheel of the exerciser is connected to two pedals 10 at two ends of the bar 14 and the other end of each of the two pedals 10 is connected to respective one of the two arms 13.

Figure 11:
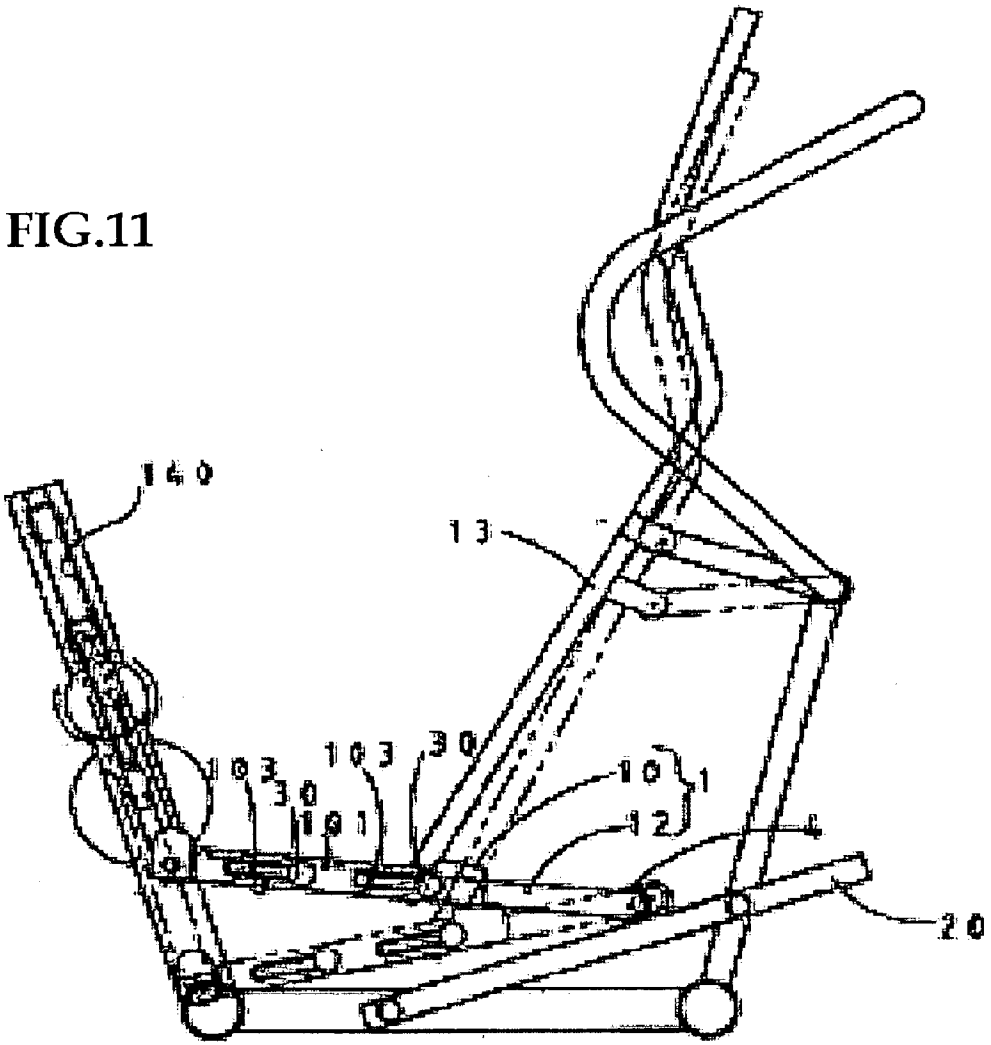
FIG. 11 shows another arrangement of the pedal structure of the present invention in another elliptical exerciser.

FIG. 11 shows another arrangement of the pedal structure of the present invention in a stair climbing exerciser, wherein two arms 140 and 13 are respectively connected to each of the pedals 10 and an end of the pedal 10 has a wheel 4 connected thereto. The two respective wheels 4 may roll on an inclined board 20 so that the pedals 10 are moved by the wheels 4 rolling on the inclined board 20.

While we have shown and described the embodiment in accordance with the present invention, it should be clear to those skilled in the art that further embodiments may be made without departing from the scope of the present invention.

What is claimed is:

1. A pedal structure comprising:

a pedal having a groove defined therein an underside thereof and two positioning ports defined in a side of the pedal, each of the positioning ports including continuous notches which are in communication with each other, an operation rod engaged with the groove and two connection ports located on the operation rod, the connection ports communicating with the positioning ports, and two positioning members each having a head portion, a plain section and a threaded section, the threaded section being threadedly connected to the connection port corresponding thereto and the plain section slidably shifted between the continuous notches of the positioning ports.

* * * * *